United States Patent [19]

Neumann

[11] Patent Number: 4,741,173

[45] Date of Patent: May 3, 1988

[54] AUGER TYPE ICEMAKER

[75] Inventor: Charles G. Neumann, Palatine, Ill.

[73] Assignee: Reynolds Products, Inc., Schaumburg, Ill.

[21] Appl. No.: 823,826

[22] Filed: Jan. 28, 1986

Related U.S. Application Data

[63] Continuation of Ser. No. 610,962, May 16, 1984, abandoned, which is a continuation-in-part of Ser. No. 381,433, May 24, 1982, abandoned, which is a continuation of Ser. No. 205,786, Nov. 10, 1980, abandoned.

[51] Int. Cl.[4] ..... F25C 1/14

[52] U.S. Cl. ..... 62/298; 62/354

[58] Field of Search ..... 62/354, 320, 298

[56] References Cited

U.S. PATENT DOCUMENTS

| | | | |
|---|---|---|---|
| 2,825,209 | 3/1958 | Nelson et al. | 62/354 X |
| 3,196,628 | 7/1965 | Reynolds | 62/354 X |
| 3,256,710 | 6/1966 | Dedricks et al. | 62/320 |
| 3,372,558 | 3/1968 | Guard | 62/320 |
| 3,756,041 | 9/1973 | Hanson | 62/354 |
| 3,844,134 | 10/1974 | Krueger et al. | 62/354 |
| 4,182,193 | 1/1980 | Schultz, Jr. | 403/359 X |
| 4,497,184 | 2/1985 | Utter et al. | 62/354 |

*Primary Examiner*—William E. Wayner

*Attorney, Agent, or Firm*—Shenier & O'Connor

[57] ABSTRACT

An auger type ice maker in which the auger is supported by a thrust bearing carried by the extruding head at the top of the evaporator and in which the extruding head itself is entirely symmetrical around the axis of rotation of the auger and in which means is provided for preventing rotation of the ice in the plenum formed by the extruding head above the upper end of the auger. The auger is not required to compress the ice against any plate or other means which closes the upper end of an extruding passage as ice is being delivered to lower end thereof. The extruding head is formed with radially outwardly extending lugs received in slots in the upper surface of a flange at the top of the evaporator housing which lugs also are received in slots formed in a flange at the bottom of the storage housing so as to position the housing circumferentially above the axis of rotation of the auger.

12 Claims, 5 Drawing Sheets

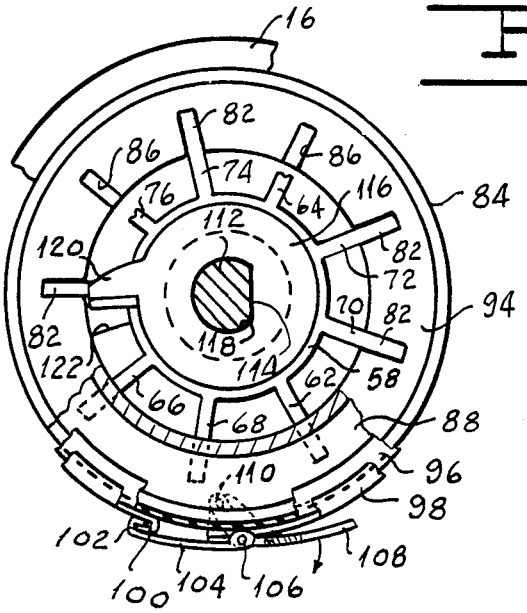
Fig 2
Fig 3
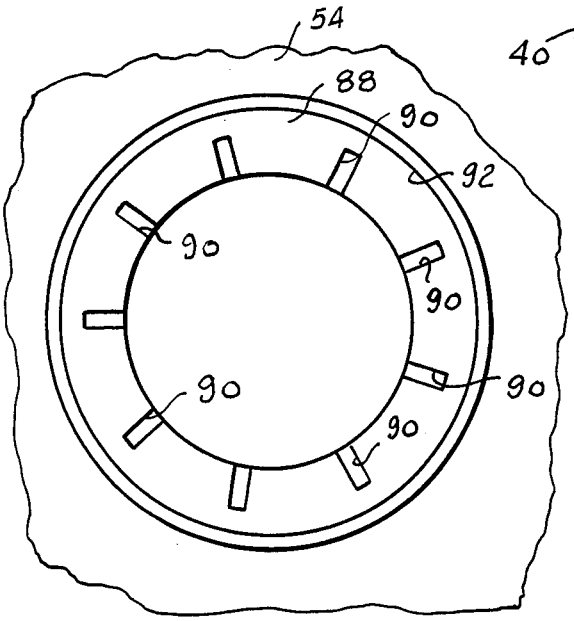
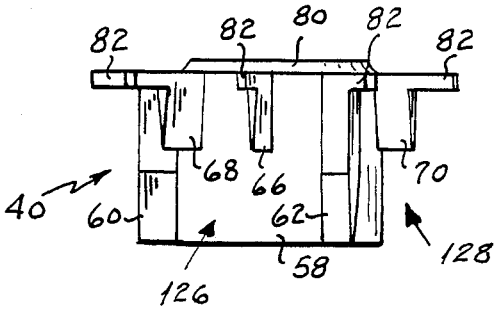
Fig 4

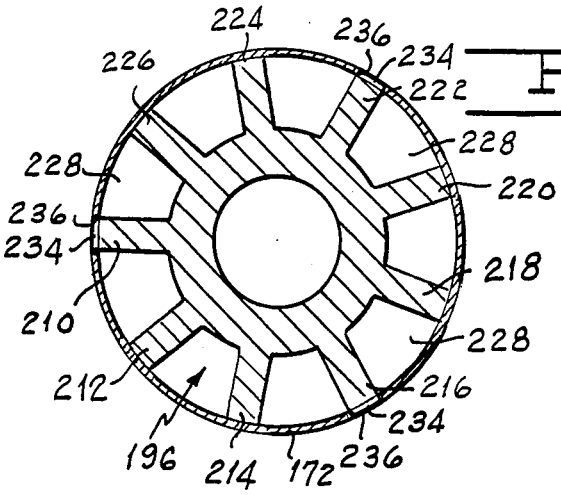
Fig 11
Fig 10
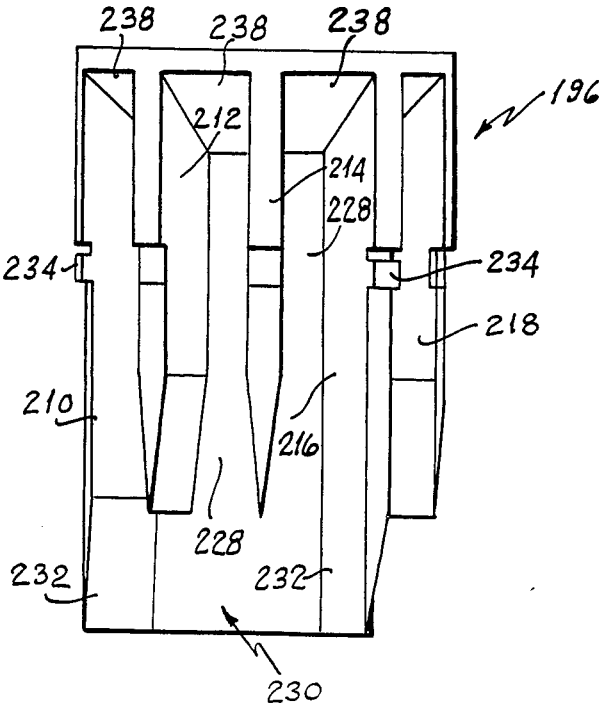

AUGER TYPE ICEMAKER

CROSS-REFERENCE TO RELATED APPLICATIONS

This is a continuation of co-pending application Ser. No. 610,962, now abandoned, which was a continuation-in-part of application Ser. No. 381,433, filed May 24, 1982, now abandoned, which was a continuation of application Ser. No. 205,786, filed Nov. 10, 1980, now abandoned.

My invention is in the field of ice makers, and more particularly, in the field of ice makers of the auger type.

BACKGROUND OF THE INVENTION

Various types of ice makers are known in the prior art. One form of ice maker incorporates an auger which is mounted for rotary movement within the cylindrical chamber of an evaporator to which water is supplied to cause ice crystals to form on the inner surface of the evaporator. As the auger rotates, the blade thereof scrapes the ice crystals off the surface of the evaporator and advances the ice upwardly toward an extruding head which forms a plenum at the top of the auger and a plurality of extruding passages extending upwardly from the plenum toward an ice cube storage chamber. A breaker blade which rotates with the auger has a passage-blocking portion which normally covers the upper end of an extruding passage as the auger forces ice upwardly into the passage so that the ice is compressed against the breaker blade. As the breaker blade moves away from the top of the passage, a rod of ice emerges which is broken by the rotating blade into pieces of relatively hard ice.

U.S. Pat. Nos. 3,196,624 and 3,196,628 both disclose ice makers of the type discussed hereinabove. In the ice makers shown in these patents, the extruding head includes a central cylindrical body portion which extends upwardly from the upper end of the auger to the lower ends of the extruding passages. Respective relatively large bosses which accommodate the head mounting screws to the lower ends of the extruding passages, extend axially upwardly and radially outwardly of a central cylindrical portion of the head from a location spaced a distance above the upper end of the auger. These bosses cooperate with relatively thin fins disposed between respective pairs of the bosses to form the extruding passages. A combined radial and thrust bearing at the lower end of the evaporator housing supports the auger for rotary movement. It will readily be appreciated that in the course of forcing ice through the extruding head, relatively large thrust forces are produced.

I have discovered that, while the ice maker disclosed in the patents referred to hereinabove functions in a generally satisfactory manner in making ice, it incorporates a number of defects. First, the plenum formed by the cylindrical portion of the extruding head below the relatively large bosses which facilitate mounting of the head on the evaporator chamber, results in the formation of a donut-shaped body of ice which rotates with the auger. As additional ice is harvested by the auger and forced up into the plenum, the torus of ice is forced up against the bosses and is fractured so that the ice formed in the extrusion passage immediately following each one of the bosses in the direction of auger rotation, is not as of high quality as is desired.

Secondly, the thrust bearing at the lower end of the evaporator housing which supports the auger is relatively inaccessible and quite difficult to service. Bearings of relatively exotic materials which can function satisfactorily in the water environment at this location for relatively long periods of time are not readily available. Moreover, it will readily be appreciated that this thrust bearing requires a disassembly of substantially the entire ice maker for replacement. A further defect of the ice maker shown and described in the patents referred to hereinabove, results in the fact that the hard ice is formed by compressing the body of ice against the breaker blade which rotates with the auger. Owing to this fact, each extruding head must be tailored specifically for the compressor with which it is to be used if ice of satisfactory quality is to be produced.

SUMMARY OF THE INVENTION

One object of my invention is to provide an auger type ice maker which is an improvement over auger type ice makers known in the prior art.

Another object of my invention is to provide an auger type ice maker which produces ice of higher quality than do auger type ice makers known in the prior art.

Yet another object of my invention is to provide an auger type ice maker which is more efficient than are auger type ice makers in the prior art.

A further object of my invention is to provide an auger type ice maker which is more easily serviced than are auger type ice makers of the prior art.

A still further object of my invention is to provide an auger type ice maker in which the same extruding head can accommodate compressors having a relatively wide range of capacities without affecting the quality of the ice.

Still another object of my invention is to provide an auger type ice maker which permits one hopper to be replaced by a hopper of a different capacity without the use of tools.

A still further object of my invention is to provide an auger type ice maker in which the location of the hopper outlet around the axis of rotation of the auger can be changed without the use of tools.

Other and further objects of my invention will appear from the following description.

In general, my invention contemplates the provision of an auger type ice maker in which the auger is supported by a thrust bearing carried by the extruding head at the top of the evaporator and in which the extruding head itself is entirely symmetrical around the axis of rotation of the auger and in which means is provided for preventing rotation of ice in the plenum formed by the extruding head above the upper end of the auger. In my improved auger type ice maker, the auger is not required to compress the ice against any plate or other means which closes the upper end of an extruding passage as ice is being delivered to lower end thereof. My improved ice maker has an extruding head formed with radially outwardly extending lugs received in slots in the upper surface of a flange at the top of the evaporator housing which lugs also are received in slots formed in a flange at the bottom of the storage housing so as to position the housing circumferentially above the axis of rotation of the auger.

BRIEF DESCRIPTION OF THE DRAWINGS

In the accompanying drawings in which reference is made in the instant specification and which are to be read in conjunction therewith and in which like reference characters are used to indicate like parts in the various views;

FIG. 2 is a sectional view of my improved auger type ice maker, taken along the line 2—2 of FIG. 1 with parts broken away and with other parts shown in section.

FIG. 3 is a fragmentary bottom plan view of the hopper of my improved auger type ice maker taken along the line 3—3 of FIG. 1.

FIG. 4 is an elevation of one form of extrusion head which can be used with my improved auger type ice maker.

FIG. 10 is an elevation of the extruding head of the form of my improved auger type ice maker shown in FIG. 9.

FIG. 11 is a sectional view of the form of my improved auger type ice maker shown in FIG. 9 and taken along the line 11—11 thereof.

DESCRIPTION OF THE PREFERRED EMBODIMENT

Figure 1:
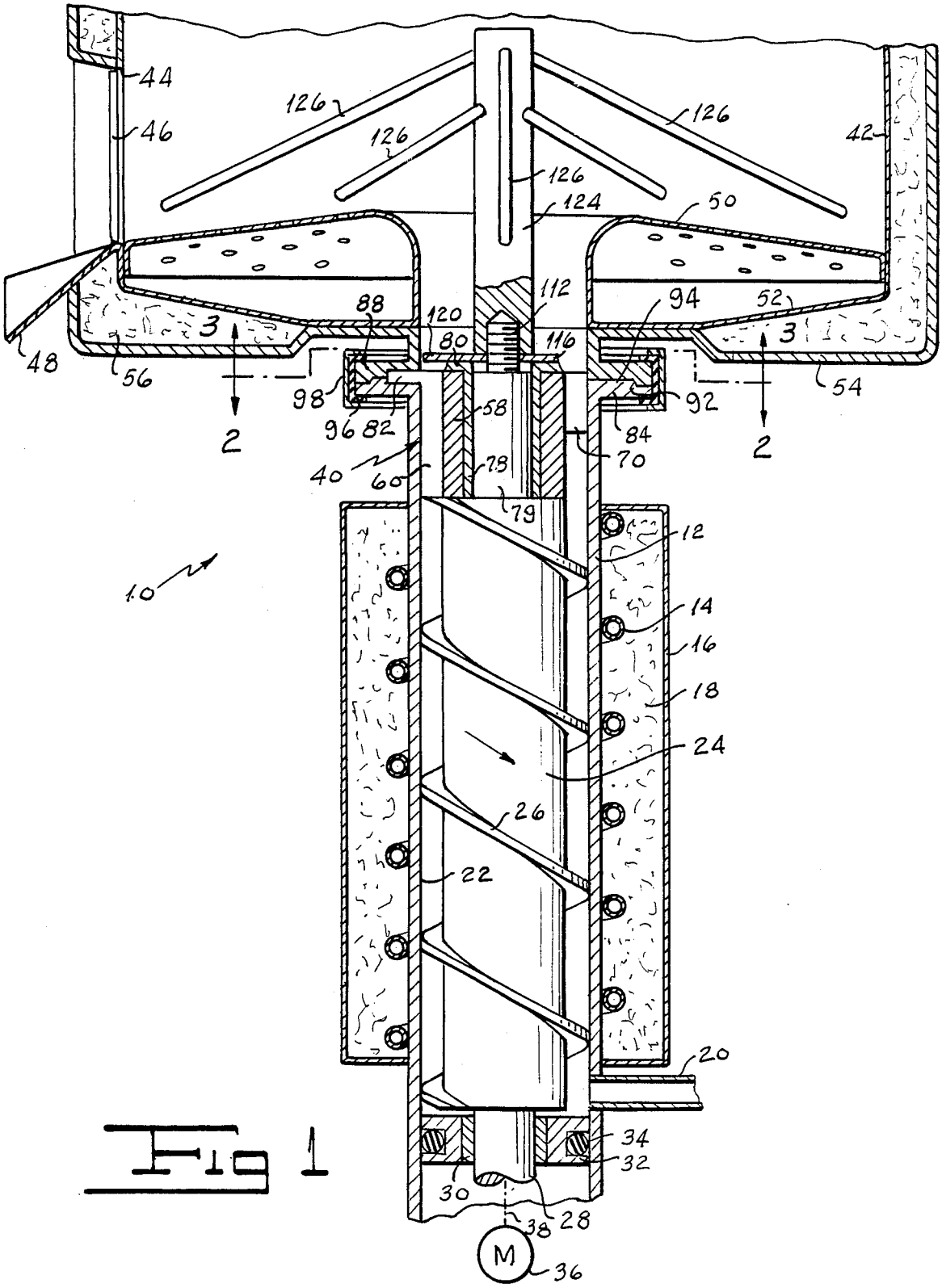
FIG. 1 is a fragmentary sectional view of my improved auger type ice maker with parts broken away and with other parts shown schematically.

Referring now to FIGS. 1 to 4, my improved auger type ice maker indicated generally by the reference character 10, includes an evaporator housing 12 surrounded by a coil 14 through which refrigerant is passed in a manner known to the art to chill the housing 12. A jacket 16 containing insulation 18 surrounds the coil 14. A pipe 20 leading from any suitable source of water supplies water to the inner freezing surface 22 of the housing 12.

An auger 24 having a helical blade 26 has a lower shaft portion 28 which is received in a radial bearing 30 supported in a ring 32 carrying a seal 34 which prevents the escap of water. A motor 36 is adapted to be energized in a manner described more fully in the Reynolds patents, supra, to drive a mechanical coupling 38 to drive shaft 28 to rotate the auger 24 in the direction indicated by the arrow in FIG. 1 to cause the blade 26 to scrape ice crystals off the surface 22 and to advance these crystals upwardly toward an extrusion head indicated generally by the reference character 40 to be described more fully hereinbelow.

Ice is delivered by the head 40 to a storage bin 42 having an outlet 44 in the wall thereof which is normally closed by a door 46. As is more fully described in the Reynolds patents, supra, when ice is to be delivered from the storage bin 42 door 46 is opened to permit ice to move outwardly along chute 48. Bin 42 is provided with a perforated false bottom 50 extending over a bottom 52 which is inclined inwardly and downwardly so as to deliver melt-down water toward the center of the bin 42. A jacket 54 filled with insulation 56 surrounds the major portion of the bin 42.

The head 40 includes a central body portion 58 formed with three equally circumferentially spaced radially and axially extending full fins 60, 62 and 64 extending from top to bottom of the body 58 and tapering to knife edges at the lower ends thereof. I provide the body 58 with respective pairs of relatively shorter fins 66 and 68, 70 and 72, and 74 and 76, between adjacent pairs of full fins. These shorter fins 66 through 76 extend downwardly from the top of the body 58 for a distance which is appreciably less than the full length of the body 58. As is the case with the fins 60, 62 and 64, the shorter fins taper downwardly toward their lower ends. The overall result of the structure just described is that the extruding head 40 is completely symmetrical around the axis of rotation of the auger 24 in the region of the extruding passages formed by the fins.

I provide the interior of the body portion 58 with a liner sleeve 78 of a suitable bearing material which permits the liner to act as a radial bearing for an upper auger shaft portion 79. In addition, I form the upper end of the sleeve 78 with a radially outwardly extending flange 80 which, as will be described more fully hereinbelow, acts as a thrust bearing for receiving the thrust generated by the auger as it moves ice upwardly through the extruding head 40.

I form each of the fins 60 through 76 at the upper end thereof with a radially outwardly directed locating lug 82. When the head 40 is assembled in the upper end of the evaporator housing 12, the lugs 82 are received in locating slots 86 formed in a flange 84 at the upper end of the evaporator housing. I provide the hopper jacket 54 with a mounting flange 88 having a plurality of radially extending locating slots 90 in the underside thereof which are equal in number to the number of locating lugs. Thus, as the bin 42 is mounted on the evaporator housing assembly, lugs 82 are received in the slots 90 to position the hopper 42 circumferentially around the axis of rotation of the auger 24. In the particular embodiment illustrated in FIGS. 1 to 4, it will readily be appreciated that the hopper 42 can be located in one of nine positions spaced 40° apart. In addition, I form an annular step 94 in the upper surface of the evaporator flange which is received in a recess 92 in the hopper jacket flange so as to locate the hopper 42 with reference to the auger 24.

In the course of assembling the hopper on the evaporator in the manner described, I position an annular gasket 96 around the edges of both flanges 84 and 88 to prevent the escape of melt-down water. Finally, I readily releaseably secure the parts together by means of a quick release clamp 98 extending around the periphery of the flanges. More specifically, a hook 100 at one end of the band clamp 98 receives a hook 102 in one end of a link 104 supported on a pivot pin 106 carried by a handle 108 supported on pivot 110 at the other end of the clamp 98. As will readily be appreciated by those skilled in the art, the clamp may easily be released without the use of tools by moving the handle 108 in the direction of the arrow in FIG. 2.

A threaded shaft portion 112 of reduced diameter extending upwardly from shaft portion 79 is provided with a flat 114. A thrust plate 116 having an opening 118 corresponding to the outline configuration of shaft portion 112 is assembled thereon for rotation therewith. The flat 114 not only causes the thrust plate 116 to rotate with the shaft portion 112 but also it orients a breaker finger 120 extending radially outwardly therefrom in the correct relationship with the upper edge 122 of the auger blade 26.

The machine 10 includes an agitator hub 124 having an internal bore which permits the hub to be screwed onto the shaft portion 112 to force the plate 116 down into engagement with the thrust bearing portion 80. The hub 124 carries a plurality of agitator fingers 126 to prevent pieces of ice in the bin from forming a solid mass.

My improved extruding head 40 forms a plenum including three plenum subspaces located between the upper end of the auger and the lower ends of the pairs of shorter fins 66 and 68, 70 and 72, and 74 and 76 between the lower ends of adjacent pairs of the longer fins 60 and 62, 62 and 64, and 64 and 60. By way of example, two of these plenum subsections are indicated generally by the respective reference characters 126 and 128 in FIG. 4. It will readily be appreciated that ice moved into these plenum spaces cannot rotate with the auger. That is to say, the portions of the longer fins 60, 62 and 64 extending from the lower ends of the shorter fins to the upper end of the auger prevent rotation of any body of ice in the plenum including sections 126 and 128.

Figure 5:
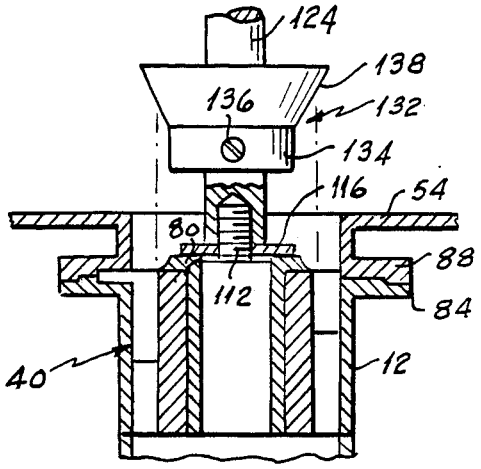
FIG. 5 is a fragmentary sectional view of my improved auger type ice maker illustrating an alternate form of ice rod breaking device.

Referring now to FIG. 5, I have shown an alternate means for breaking the rods of ice emerging from the extrusion passages formed by the fins of the head 40. In this form of my invention, rather than using the breaker finger 120, I secure what may be termed an "inner diameter" breaker member indicated generally by the reference character 132 to the hub 124 for rotation therewith. For example, member 132 may be formed with a collar 134 secured to the hub 124 by means of a set screw 136 or the like. An upwardly and outwardly extending portion 138 of the breaker member 132 provides a surface against which the rods of ice moving upwardly out the passages between the fins of the head 40 impinge. Owing to the inclination of the surface of the portion 138, pieces of ice break off the rods as they move upwardly.

Figure 6:
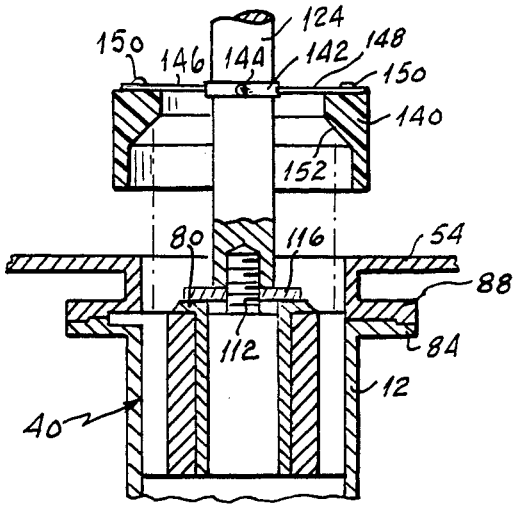
FIG. 6 is a fragmentary sectional view of my improved auger type ice maker illustrating a still further form of ice rod breaking device.

Referring now to FIG. 6, a still further form of ice breaker 145, which may be termed an "outer diameter" breaker, is secured to the hub 124. For example, a collar 142 secured to the hub 124 by means of a set screw 144 or the like carries a plurality of arms 146 and 148 which extend outwardly and which are secured to the member 140 by means of screws 150 or the like. I form the inside of the member 140 with an upwardly and inwardly directed surface portion 152 against which the outer edges of the rods of ice impinge as they move upwardly out of the extrusion passages formed in the head 40.

Figure 7:
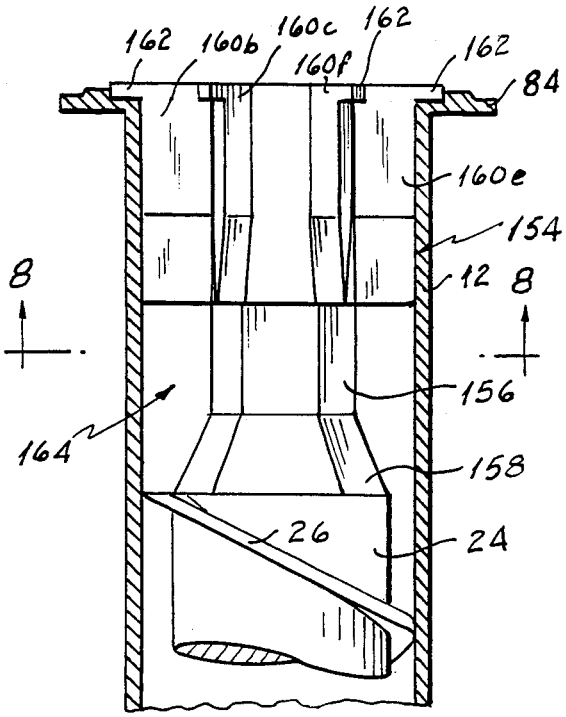
FIG. 7 is a fragmentary sectional view of my improved auger type ice maker illustrating an alternate embodiment of the extrusion head of the ice maker.
Figure 8:
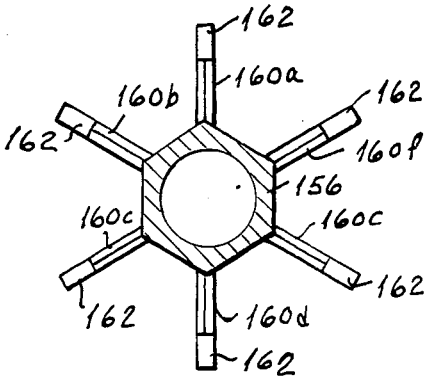
FIG. 8 is a sectional view of the form of my improved auger type ice maker illustrated in FIG. 7 and taken along the line 8—8 thereof.

Referring now to FIGS. 7 and 8, I have shown an alternate form of extrusion head indicated generally by the reference character 154 having a central portion 156 of hexagonal cross section and a lower portion 158 having a plurality of sides which extend downwardly and outwardly for some distance from the sides of the intermediate section 156. I provide the head 154 with a plurality of radially outwardly directed fins **160*a* through 160*f*, all of which are of the same axial length and which form six extrusion passages. Lugs 162 on the outer ends of the tops of fins 160*a* through 160*f* perform the same function as do the lugs 82 in the form of my invention illustrated in FIGS. 1 to 4. Moreover, owing to the shape of the intermediate section 156 and the lower section 158, ice moving into the plenum between the lower ends of the blades or fins 160*a* through 160*f* and the upper end of the auger 24** is prevented from rotating with the auger.

Figure 9:
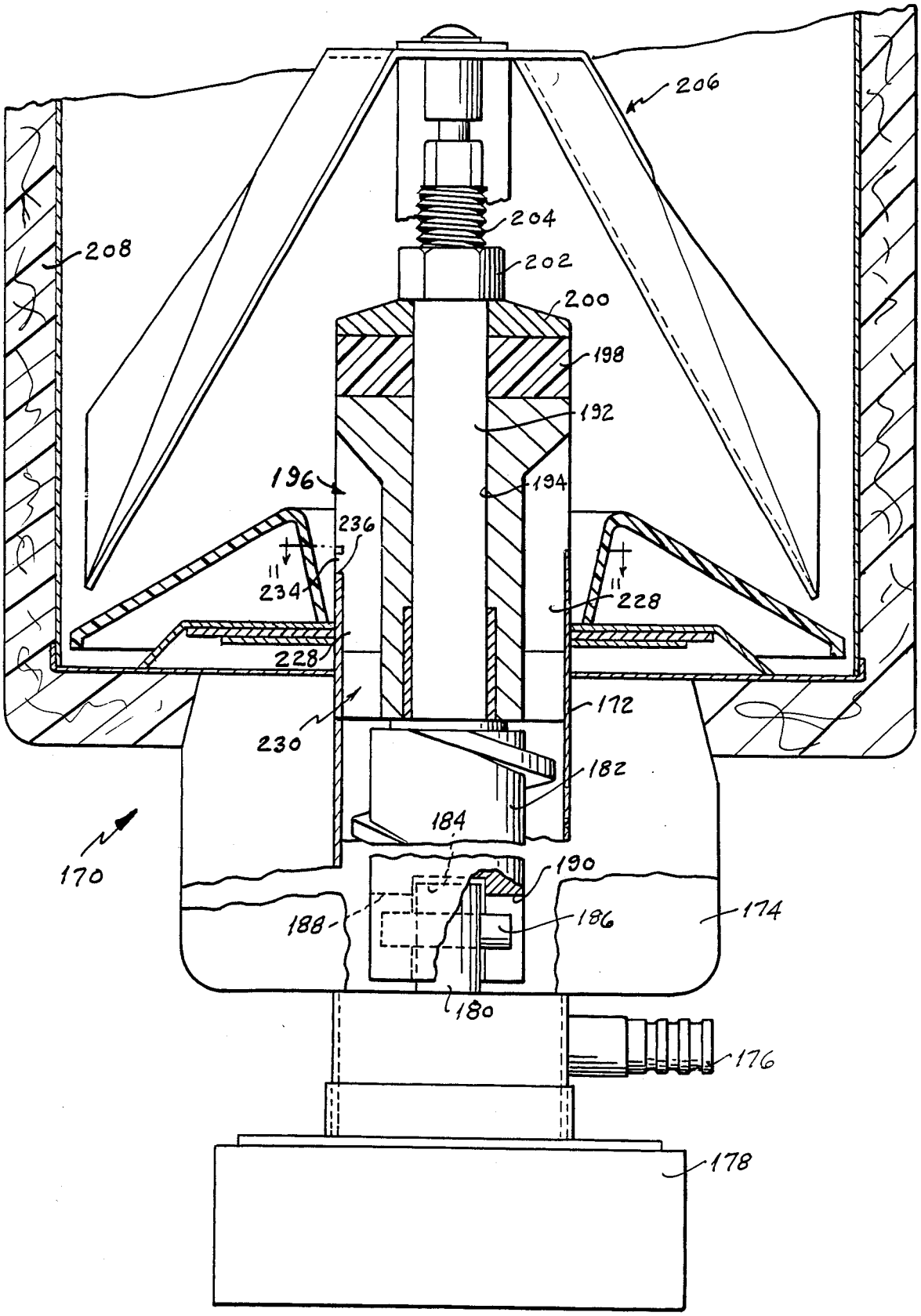
FIG. 9 is an elevation of an alternate embodiment of my improved auger type ice maker with parts shown in section.

Referring now to FIGS. 9 to 11, an alternate embodiment of our new improved ice maker, indicated generally by the reference character 170, includes a hollow cylinder 172 providing a freezing surface. A jacket 174 carrying the refrigerating coils (not shown) and associated insulating material surrounds the cylinder 172. A water inlet 176 is adapted to admit water to the interior of cylinder 172.

A drive gear motor 178 has an output shaft 180 which is adapted to drive the auger 182 disposed within the cylinder 172. Shaft 180 extends upwardly into a bore 184 in the lower end of the auger 182. A transverse pin 186 carried by the shaft 180 engages in slots 188 and 190 extending outwardly from the bore 184. In this way we provide a readily releasable driving connection between the shaft 180 and the auger 182. It will readily be appreciated that this connection is broken merely by drawing the auger 182 upwardly out of the cylinder 172 in a manner to be described hereinbelow.

A shaft 192 integral with the auger 182 extends upwardly through a central bore 194 in the extruding head indicated generally by the reference character 196. From the extruding head 196 shaft 192 extends upwardly through a thrust bearing 198 surrounding the shaft and through a cap 200. A nut 202 carried by a threaded portion 204 of shaft 192 holds the cap 200 and the thrust bearing 198 in assembled relationship with the extruding head 196. An agitator indicated generally by the reference character 206 is secured to the upper end of shaft 192 by any suitable means. Agitator 206 is adapted to prevent the pieces of ice in the bin 208 from freezing together to form a solid mass.

Referring to FIGS. 10 and 11, the extruding head 196 is formed with a plurality of fins 210, 212, 214, 216, 218, 220, 222, 224 and 226. Adjacent pairs of fins cooperate to provide a plurality of extruding passages 228 leading upwardly from a plenum toward breaker surfaces 238 at the top of the head 196. We provide fins 210, 222, and 216 with extensions 232 going downwardly from the lower end of the other fins to the bottom of the head and into the plenum 230 to prevent rotation with the auger of any body of ice which forms in the plenum 230. We also provide the fins 210, 222 and 216 with lugs 234 which engage in slots 236 in the upper end of the cylinder 172 to prevent rotation of the extruding head with the auger.

It is to be noted that I may desire to provide a radial bearing in the bore 194 of the extruding head 196.

In operation of the form of my improved auger type ice maker shown in FIG. 1, the hopper 42 can readily be removed from the evaporator assembly without the use of tools merely by opening the releasable clamp by moving the handle 108 in the direction of the arrow shown in FIG. 2. This facilitates changing the hopper to one of greater or lesser capacity as is desired. This feature also facilitates changing the orientation of the hopper around the axis of rotation of the auger as it may be necessary or desirable.

Further, in all forms of my invention, ice moved into the plenum is prevented from rotating with the auger. In the form of my invention illustrated in FIGS. 1 to 4, the full-length fins 60, 62 and 64 prevent any ice which moves into the plenum spaces, including spaces 126 and 128, from moving with the auger. In the embodiment of my invention illustrated in FIGS. 9 to 11, the extensions 232 on fins 210, 216 and 222 prevent rotation with the auger 182 of any body of ice in the plenum chamber 230. Moreover, in the region of the extrusion passages formed by the full-length fins and by the shorter fins, the extrusion head is entirely symmetrical, so that there is no refracturing or breaking of a solid ice body once it has been formed and before it emerges from the extruding head.

The form of my invention illustrated in FIGS. 7 and 8, functions in a similar manner in that the noncircular configuration of the sections 156 and 158 of the extruding head, prevents any body of ice moved into the plenum 164 from rotating with the auger. In addition, as is the case with the form of my invention illustrated in FIGS. 1 to 4, the extruding head 154 is completely symmetrical around the axis of rotation of the auger in the region of the extruding passages formed by the fins 160*a* to 160*f*. By this I mean that not only are all of the extrusion passages of the same size and shape, but also all of the fins forming the extrusion passages are of the same size and shape. Owing to this construction and the elimination of any large protrusions in the path of ice such as are formed by the mounting bosses separating some of the passages formed in the extrusion head shown in the Reynolds patent, supra, my head forms rods of ice in a generally smooth and continuous manner without any refracturing of ice once it has been formed and before the rod leaves the extrusion head.

It is to be noted further that in no form of my invention is the auger required to feed harvested ice into an extrusion passage which is closed at the top as in the Reynolds arrangement. Thus, in my construction, none of the compression takes place against an element which closes the upper end of the passage. For this reason, I need not tailor my head to the capacity of the compressor used or, alternatively, be limited to a compressor of a particular capacity for which a head is designed. Stated otherwise, my head will accommodate compressors having a relatively wide range of capacities, the only difference being that the rate at which ice is produced increases with the capacity of the compressor used with my improved auger type ice maker. For generally the same reason that my extrusion head is symmetrical in the region of the extrusion passages and that no compression is required to take place against a blocking member, an ice maker including my improved head is more efficient than are ice makers of the prior art using heads, such for example as that shown and described in the Reynolds patents, supra. The kind of ice, "flake", or "cube" which is produced is a function of aggregate passage cross-sectional area to aggregate fin cross-sectional area. My arrangement permits me readily manually to change the kind of ice which is produced by changing extruding heads.

A further advantage of my arrangement is the location of the thrust bearing 80 at the top of the evaporator assembly rather than at the bottom thereof. That is to say, the thrust exerted by the auger as it moves the ice upwardly into the extrusion passages formed by the head is exerted downwardly through shaft portion 112 through the hub 124 through the thrust plate 116 on to the thrust bearing portion 80 on to the extrusion head and through the lugs 82 to the evaporator flange 84. Preferably, I form the thrust bearing 80 with a step so that wear of the thrust bearing can readily be observed when the parts are manually disassembled. In any event, no matter whether the radial bearing 78 or the thrust bearing portion 80 wears first, they can readily be replaced merely by assembling a new head in the machine without the use of tools. To accomplish this, the clamp 98 is released, the bin 42 is removed, the agitator hub 124 is unscrewed, the plate 116 is removed and the head 40 can be removed and replaced without the use of tools.

The form of my improved auger type ice maker illustrated in FIG. 9 has a thrust bearing arrangement similar to that discussed in connection with FIGS. 1 to 4. That is, the thrust bearing 198 absorbs most of the thrust rather than having large thrust forces applied to a bearing below the auger. In the arrangement shown in FIG. 9, the thrust bearing 198 can be replaced by removing the agitator 206, nut 202 and cap 200.

A significant advantage of the form of ice maker shown in FIG. 9 is that the assembly of the extruding head and thrust bearing is removable as a unit from the evaporator assembly including cylinder 172 and jacket 174 without the use of tools. This is possible since, in my construction, there is no need to fasten the extruding head to the evaporator as loads are distributed in such a manner as to counteract each other.

It will be seen that I have accomplished the objects of my invention. I have provided an auger type ice maker which overcomes the defects of auger type ice makers of the prior art. My improved auger type ice maker produces ice of higher quality than do auger type ice makers of the prior art. My ice maker is more efficient than are auger type ice makers of the prior art. My auger type ice maker accommodates compressors having a relatively wide range of capacities without modification of the extrusion head. My auger type ice maker is more easily serviced than are ice makers of the prior art. The assembly of the extruding head and the auger can be removed from the evaporator without the use of tools. My improved auger type ice maker permits ready replacement of the ice storage bin with one of a different size. In addition, it permits the orientation of the bin outlet to be changed without difficulty as desired or required.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to specific details shown and described.

Having thus described my invention, what I claim is:

1. In an ice maker, apparatus including a generally vertically disposed evaporator housing having a generally cylindrical inner freezer surface on which ice crystals are adapted to form, an annular flange at the upper end of said evaporator housing, a plurality of radial grooves in the upper surface of said flange, an extruding head having a plurality of radially extending lugs adapted to be received in said grooves to support said head at the upper end of said housing, said head being formed with a bore, a sleeve of bearing material within said bore adapted to act as a radial bearing, bearing material extending over the top of said head to act as a thrust bearing, an auger within said housing adapted to be driven to harvest ice crystals from said surface and to advance said crystals toward said head, a shaft extending upwardly from said auger through said sleeve and means for translating thrust from said shaft to said thrust bearing.

2. Apparatus as in claim 1 in which said extrusion head cooperates with said housing to form an extrusion passage at the top of the housing and to form a plenum between said passage and the upper end of said auger, said apparatus including means for inhibiting rotary movement of ice in said plenum.

3. Apparatus as in claim 2 including means disposed above said head for breaking a rod of ice moving upwardly out of said passage.

4. In an ice maker, apparatus including an elongated evaporator housing having an inner generally cylindrical freezing surface on which ice crystals are adapted to form, an auger having a blade with a scraping edge, means mounting said auger for rotary movement in said housing to cause the scraping edge of said blade to scrape ice crystals off said surface and advance said crystals toward one end of said housing, an extruding head formed with a plurality of ice extruding passages each having an inlet and an outlet, means stationarily mounting said extruding head at said open end of said housing with said passage inlets spaced from the axial locus of the end of said auger blade adjacent to said one end of said housing to form an ice crystal collecting plenum chamber from which ice crystals are fed to said inlets to emerge from said outlets as relatively hard bodies of ice, and means located in said ice collecting plenum chamber and extending from said passage inlets substantially to said end of said blade edge for dividing said plenum chamber into a number of subchambers less than the number of passages while effectively preventing rotation with said auger of any body of ice in said chamber.

5. Apparatus as in claim 4 in which said ice extruding passages are formed by radial fins, said dividing means comprising an extension on one of said fins.

6. Apparatus as in claim 4 in which said dividing means comprises a portion of said extruding head of non-circular cross-sectional shape.

7. In an ice maker, apparatus including an elongated evaporator housing having an inner generally cylindrical freezing surface on which ice crystals are adapted to form, an auger having a blade, means mounting said auger for rotary movement in said housing to cause said blade to scrape ice crystals off said surface and advance said crystals toward one end of said housing, an extruding head formed with a plurality of generally straight ice extruding passages each having an inlet and outlet, means stationarily mounting said extruding head at said one end of said housing with said passages extending in the direction of the longitudinal axis of said body with said passage inlets spaced from the axial locus of the end of said auger blade adjacent to said one end of said housing to form an ice crystal collecting plenum chamber from which ice crystals are fed to said inlets under the action of said auger to emerge from said outlets generally in the direction of said axis as relatively hard bodies of ice, and means located in said ice collecting plenum chamber and extending from said passage inlets substantially to said end of said blade for dividing said plenum chamber into a number of subchambers less than the number of passages while effectively preventing rotation with said auger of any body of ice in said chamber, said auger mounting means comprising a thrust bearing between said auger and said head for absorbing a major portion of the thrust forces generated by the action of said auger in feeding ice crystals to said head.

8. In an icemaker having an evaporator housing with an inner wall providing a freezing surface on which ice crystals may form and an auger in said housing adapted to be driven to harvest ice crystals from said surface and to advance said ice crystals toward one end of said housing, an extruding head adapted to be received in said one end of said housing, said head having a pair of radially outwardly directed fins extending downwardly from the top of said head to a location intermediate the ends of the head to cooperate with the housing wall to form an extrusion passage, said fins terminating at said location whereby the portion of said head below said passage from said location to the lower end of said head cooperates with said wall to form a plenum, said portion being formed with a noncylindrical configuration throughout its extent to inhibit rotation of ice in said plenum.

9. In an icemaker, apparatus including an elongated generally vertically disposed evaporator having an inner generally cylindrical freezer surface, an extruding head formed with an ice extruding passage adapted to be positioned at the upper end of said evaporator, an auger adapted to be positioned on said evaporator below said head for rotary movement relative to said evaporator and said head to scrape ice crystals off said freezing surface and feed them to said passage, said head being formed with a bore, a shaft on said auger extending upwardly through said bore, a thrust bearing, means for assembling said thrust bearing between said shaft and the upper end of said head to absorb a major portion of the thrust forces generated by the action of said auger in scraping ice crystals off said freezing surface and feeding them to said passage, means mounting the assembly of said auger and said head and said thrust bearing on said evaporator for free axial movement as a unit from an operative position in association with said evaporator upwardly out of and away from said evaporator and means for restraining said head against rotary movement relative to said evaporator in the operative position of said unit.

10. Apparatus as in claim 9 including drive means at the lower end of said evaporator and a releasable coupling between said auger and said drive means, said coupling being releasable upon upward movement of said auger relative to said evaporator, the construction being such that the assembly of said auger and said head and said thrust bearing can be removed from said operative position to a removed position without the use of tools.

11. An assembly as in claim 10 in which said drive means comprises a shaft and in which said coupling comprises a transverse pin on said shaft and a slot in said auger for receiving said pin.

12. An assembly as in claim 9 in which said means for restraining said head comprises a slot in the upper end of said evaporator and a lug on said head adapted to be received in said slot.

* * * * *

US004741173B1

REEXAMINATION CERTIFICATE (1802nd)

United States Patent [19]

Neumann

[11] B1 4,741,173

[45] Certificate Issued Sep. 22, 1992

[54] AUGER TYPE ICEMAKER

[75] Inventor: Charles G. Neumann, Palatine, Ill.

[73] Assignee: Society National Bank

Reexamination Request:
No. 90/002,510, Nov. 14, 1991

Reexamination Certificate for:

| | |
|---|---|
| Patent No.: | 4,741,173 |
| Issued: | May 3, 1988 |
| Appl. No.: | 823,826 |
| Filed: | Jan. 28, 1986 |

[51] Int. Cl.[5] ..... F25C 1/14
[52] U.S. Cl. ..... 62/298; 62/354
[58] Field of Search ..... 62/354, 320, 71

[56] References Cited

U.S. PATENT DOCUMENTS

| | | | |
|---|---|---|---|
| 3,196,628 | 7/1965 | Reynolds | 62/137 |
| 3,372,558 | 3/1968 | Guard | 62/320 |
| 3,844,134 | 10/1974 | Krueger | 62/354 |
| 4,497,184 | 2/1985 | Utter et al. | 62/354 |

FOREIGN PATENT DOCUMENTS 54-134954 9/1979 Japan .

*Primary Examiner*—William E. Wayner

[57] ABSTRACT

An auger type ice maker in which the auger is supported by a thrust bearing carried by the extruding head at the top of the evaporator and in which the extruding head itself is entirely symmetrical around the axis of rotation of the auger and in which means is provided for preventing rotation of the ice in the plenum formed by the extruding head above the upper end of the auger. The auger is not required to compress the ice against any plate or other means which closes the upper end of an extruding passage as ice is being delivered to lower end thereof. The extruding head is formed with radially outwardly extending lugs received in slots in the upper surface of a flange at the top of the evaporator housing which lugs also are received in slots formed in a flange at the bottom of the storage housing so as to position the housing circumferentially above the axis of rotation of the auger.

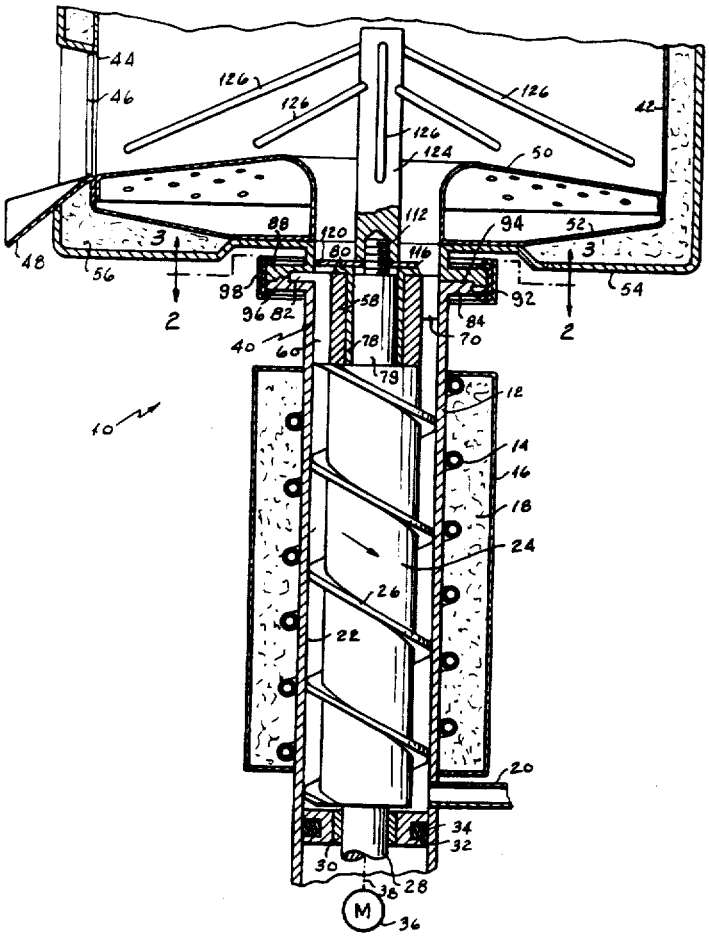

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-3 and 6-12 is confirmed.

Claims 4 and 5 are cancelled.

New claim 13 is added and determined to be patentable.

*13. In an ice maker, apparatus including an elongated evaporator housing having an inner generally cylindrical freezing surface on which ice crystals are adapted to form, said housing having an opening at least at one end, an auger having a blade with a scraping edge and first and second ends, said first end of the blade being adjacent to said one end of the housing, bearing means mounting said*

*auger for rotary movement about the axis of said cylindrical freezing surface in said housing to cause the scraping edge of said blade to scrape ice crystals off said surface and advance said crystals toward said one end of said housing, an extruding head having a central body portion extending along said axis, and formed with a plurality of ice extruding passages each passage having an inlet and an outlet and an outer boundary, the outer boundaries of the passages being situated substantially in an imaginary cylinder, means stationarily mounting said extruding head at said open one end of said housing with said passage inlets axially spaced from the axial locus of the said first end of said auger blade adjacent to said one end of said housing to form an ice crystal collecting plenum chamber, around the portion of said head between said passage inlets and said locus of said first end of said auger blade, from which ice crystals are fed to said inlets to emerge from said outlets as relatively hard bodies of ice, and divider means on said extruding head, said divider means being located in said ice collecting plenum chamber, extending radially from said central body portion to said imaginary cylinder and extending axially from said passage inlets toward said locus of said first end of said blade edge, and terminating substantially at said locus, said divider means dividing said plenum chamber into a number of subchambers less than the number of passages while effectively preventing rotation with said auger of any body of ice in said chamber.*

* * * * *